US012279704B2

(12) United States Patent
Wolf et al.

(10) Patent No.: US 12,279,704 B2
(45) Date of Patent: Apr. 22, 2025

(54) DISPENSER FOR DISPENSING ELONGATE BEVERAGE CONTAINERS

(71) Applicant: Cuula GmbH, Vienna (AT)

(72) Inventors: Werner Wolf, Aflenz (AT); Kurt Hofer, Vienna (AT)

(73) Assignee: CUULA GMBH, Vienna (AT)

( * ) Notice: Subject to any disclaimer, the term of this patent is extended or adjusted under 35 U.S.C. 154(b) by 854 days.

(21) Appl. No.: 17/605,345

(22) PCT Filed: Apr. 23, 2020

(86) PCT No.: PCT/AT2020/060163
§ 371 (c)(1),
(2) Date: Oct. 21, 2021

(87) PCT Pub. No.: WO2020/215112
PCT Pub. Date: Oct. 29, 2020

(65) Prior Publication Data

US 2022/0225792 A1 Jul. 21, 2022

(30) Foreign Application Priority Data

Apr. 23, 2019 (AT) ..... A 50366/2019

(51) Int. Cl.
*A47F 1/12* (2006.01)
*A47F 3/04* (2006.01)
(Continued)

(52) U.S. Cl.
CPC ..... *A47F 1/12* (2013.01); *A47F 3/0439* (2013.01); *F25B 21/02* (2013.01); *F25D 31/007* (2013.01); *F25D 2331/805* (2013.01)

(58) Field of Classification Search
CPC ..... F25B 21/02; F25D 31/007
See application file for complete search history.

(56) References Cited

U.S. PATENT DOCUMENTS 6,142,316 A 11/2000 Harbour et al.
6,764,273 B1 * 7/2004 Freudelsperger .... B65G 59/103 221/238
(Continued)

FOREIGN PATENT DOCUMENTS

CL 202102771 10/2021
CN 1633577 A 6/2005
(Continued)

OTHER PUBLICATIONS

China Opinion Notice and Search Report (CN 202080031214.9) dated Mar. 18, 2022.

*Primary Examiner* — Gene O Crawford
*Assistant Examiner* — Ayodeji T Ojofeitimi
(74) *Attorney, Agent, or Firm* — Daniel J. Chalker; Edwin S. Flores; Chalker Flores, LLP

(57) ABSTRACT

A dispenser (1) for dispensing elongate beverage containers (2) having: a housing (3) with a cylindrical housing part (4), a rear-side insertion opening (12) for inserting beverage containers (2) and a front-side removal element (6), open at the top, for removing the frontmost beverage container (2); a guide channel (10) with a sliding surface (11) sloping downwards towards the front for conveying the upright beverage containers (2) from the rear-side receiving opening (12) into the front-side removal element (6); a chiller device (9) for chilling the beverage containers (2); a clamping device (34) for clamping in place an edge region (35) of an advertising film (33) on the exterior of the cylindrical housing part (4), the clamping device (34) having, on a long side of the cylindrical housing part (4), a clamping strip (36) comprising at least one ventilation opening (37) for dissipating heated air from the chiller device (9) to the surroundings.

19 Claims, 6 Drawing Sheets

(51) Int. Cl.
*F25B 21/02* (2006.01)
*F25D 31/00* (2006.01)

(56) References Cited

U.S. PATENT DOCUMENTS

| | | | | |
|---|---|---|---|---|
| 2002/0185498 | A1* | 12/2002 | Riordan | G07F 11/04 221/196 |
| 2006/0157493 | A1* | 7/2006 | Christoffersen | A47F 1/106 221/36 |
| 2008/0093371 | A1* | 4/2008 | Ubidia | B25J 9/041 901/14 |
| 2008/0148753 | A1 | 6/2008 | Welker et al. | |
| 2009/0179042 | A1* | 7/2009 | Milan | G07F 9/105 62/235.1 |
| 2011/0011099 | A1 | 1/2011 | Linder | |
| 2011/0225981 | A1 | 9/2011 | Glaros et al. | |

FOREIGN PATENT DOCUMENTS

| | | | |
|---|---|---|---|
| CN | 201731705 | U | 2/2011 |
| DE | 202016002796 | U1 | 8/2016 |
| JP | 2004294016 | A | 10/2004 |
| KR | 20160100625 | A | 8/2016 |
| WO | 2016179624 | A1 | 11/2016 |

* cited by examiner

DISPENSER FOR DISPENSING ELONGATE BEVERAGE CONTAINERS

CROSS-REFERENCE TO RELATED APPLICATIONS

This application is the National Stage of International Application No. PCT/AT2020/060163, filed on Apr. 23, 2020, which claims priority to AT A 50366/2019, filed on Apr. 23, 2019, the entire contents of each of which is incorporated by reference herein.

TECHNICAL FIELD OF THE INVENTION

The present invention relates in general to the field of containers, and more particularly, to dispensing beverage containers.

BACKGROUND OF THE INVENTION

None.

BRIEF SUMMARY OF THE INVENTION

The invention relates to a dispenser for dispensing elongate beverage containers, in particular beverage cans, having:

- a housing with a cylindrical housing part, a rear-side insertion opening for inserting beverage containers and a front-side removal element, open at the top, for removing the frontmost beverage container,
- a guide channel with a sliding surface sloping downwards towards the front for conveying the beverage containers in an upright state from the rear-side receiving opening into the front-side removal element,
- a chiller device for chilling the beverage containers.

Such a can dispenser is known from WO2016/179624, in which the beverage containers, in an upright state, are inserted into the guide channel via the receiving opening and are conveyed along the sliding surface into the removal element, from which the frontmost beverage can be lifted out. This can dispenser is particularly well suited for shops in which the customers can remove the cans themselves from the can dispenser. The cylindrical housing upper part could basically be used for the mounting of an advertising film, however no possibility is indicated for the exchanging of such an advertising film. In order to cool down the cans to the drinking temperature, furthermore a high cooling capacity is necessary. In operation of the chiller device, a considerable exhaust air occurs, which can disturb the customer in front of the can dispenser.

Different devices are shown in US 2011/225981 A1, U.S. Pat. No. 6,173,582 B1 and AU 4862600 A.

The object of the present invention consists in mitigating or respectively eliminating at least individual disadvantages of the prior art. The invention therefore aims in particular to improve the chilling function and advertising function of the dispenser by structurally simple means.

This problem is solved by a dispenser having the features of Claim 1. Preferred embodiment variants are indicated in the dependent claims.

According to the invention, the dispenser is equipped with a clamping device for clamping in place an edge region of an advertising film on the exterior of the cylindrical housing part. The clamping device comprises on a long side of the cylindrical housing part a clamping strip comprising at least one ventilation opening for dissipating heated air from the chiller device to the surroundings.

Advantageously, the clamping strip therefore fulfils two basically different functions. On the one hand, the clamping strip enables the exchange of the advertising film on the exterior of the cylindrical housing part. For this purpose, the clamping strip can be transferred between a clamping position, clamping the edge region of the advertising film in place, and a releasing position, releasing the edge region of the advertising film. In the clamping position, the clamping strip presses the edge region of the advertising film against the exterior of the cylindrical housing part. In the releasing position, the clamping strip is lifted off from the exterior of the cylindrical housing part. If required, the advertising film can therefore be exchanged with minimal effort for another advertising film having a different imprint. On the other hand, the clamping strip has the ventilation opening through which exhaust air occurring in operation of the chiller device can be dissipated from the interior of the housing into the surroundings. As the clamping strip is situated on one of the long sides of the elongate cylindrical housing part, the exhaust air is blown off towards the side via the ventilation opening, therefore not forwards in the direction of the removal element and also not towards the back in the direction of the rear-side insertion opening. Advantageously, therefore, neither a customer in front of the dispenser nor a salesperson behind the dispenser are exposed to intrusive streams of exhaust air. The clamping strip can thus be utilized at the same time for the improvement of the directing of exhaust air.

On the rear side of the dispenser, i.e. opposite the removal element, the receiving opening is provided, which is preferably arranged substantially perpendicularly to the sliding surface and is configured in accordance with the cross-section of the guide channel. The beverage containers can be delivered into the guide channel in vertical or respectively upright state via the receiving opening, wherein the beverage containers are conveyed one behind the other, in isolated state under the influence of gravity along the sliding surface. For this purpose, the sliding surface is inclined towards the front in the direction of the removal element. The angle of the sliding surface to the horizontal amounts in particular to between 10° and 20°, for example substantially 15°. The sliding movement of the beverage containers during filling is stopped by the respectively preceding beverage container or—in the unfilled state—by the upwardly open removal element, which is preferably accessible free of a barrier, in particular without a flap or suchlike. The dispenser can thus be filled individually with the beverage containers. Advantageously, the filling can be carried out in the mounted state of use of the device, with inclined sliding surface. Unlike in the prior art, it is therefore not necessary to open the device and to place the beverage containers into the guide channel. In particular, in the embodiment according to the invention, it is also not necessary to bring the guide channel into a horizontal position for the introducing of the beverage containers. The beverage containers can be inserted via the rear-side receiving opening, wherein the beverage containers slide individually into the intended position within the guide channel or respectively the removal element. Accordingly, the device can be re-filled continuously in use. The guide channel is preferably elongated in the direction of the sliding surface, wherein in particular a single row of beverage containers can be accommodated in the guide channel.

Preferably, substantially cylindrical beverage cans, in particular 250 millilitre cans, are provided as beverage containers, which are used for example in the case of energy drinks or iced coffees. On the other hand, beverage containers with a cylindrical portion, such as beer bottles, can also be used. The embodiment of the dispenser is distinguished by a particularly small space requirement, whereby a plurality of fields of application, such as a use at sales counters or suchlike is opened up. Moreover, the refilling of the beverage containers can be substantially simplified compared to the prior art.

In order to prevent a tipping over of a beverage container, sliding in isolated state along the sliding surface, provision is preferably made that the guide channel comprises a retaining surface opposite the sliding surface, i.e. on the upper side, to secure the beverage container from tipping in the guide channel. Accordingly, the guide channel is embodied in a closed manner in cross-section. The upper side of the guide channel is configured as a retaining surface, by which it is reliably prevented that the beverage container tips over towards the front during sliding along the sliding surface into the intended position. For lack of a retaining surface on the upper side, the prior art would not be able to allow the beverage containers to slide in isolated state into the intended position, because the beverage containers could tip over towards the front, in particular owing to the frictional engagement on the sliding surface. By comparison, the retaining surface on the upper side of the guide channel brings it about that the beverage containers are also kept in the vertical, upright position when the beverage containers are inserted individually, i.e. not lying against one another, along the guide channel. By the retaining surface in connection with the receiving opening on the rear side of the housing, a malfunction during filling can thus be reliably prevented.

In order to secure the beverage containers against tipping over during sliding along the sliding surface in isolated state, it is advantageous if the height of the guide channel between the sliding surface and the retaining surface is 1.004 to 1.007 times, preferably substantially 1.0055 times, greater than the height of the beverage container which is arranged therein. In this embodiment, therefore at least one beverage container is part of the dispenser. The height of the guide channel, i.e. its extent perpendicularly to the sliding surface, is in the named ratio to the height or respectively longitudinal extent of the beverage container. Thereby, a slight play is created between the beverage container and the retaining surface, by which on the one hand the sliding of the beverage containers is not impeded, and on the other hand it is reliably guaranteed that the retaining surface guides a forward tipping beverage container back into the state lying over the full surface against the sliding surface.

According to a particularly preferred embodiment, the height of the guide channel between the sliding surface and the retaining surface amounts to from 135.5 mm to 136 mm, in particular substantially 135.75 mm, and the height of the beverage container arranged therein amounts to between 134.75 mm and 135.25 mm, in particular substantially 135 mm, wherein the width of the guide channel between two lateral surfaces preferably amounts to from 54 mm to 55 mm, in particular substantially 54.5 mm, and the diameter of the beverage container arranged therein amounts to from 52.75 mm to 53.25 mm, in particular substantially 53 mm.

In order to keep the cooling losses as low as possible, preferably a closure element is provided for closing the receiving opening, wherein the closure element is preferably configured as a flap which is pivotable between a usage position closing the receiving opening and a loading position, freeing the receiving opening. The flap is preferably pivotable about a horizontal pivot axis, in order to optionally free or respectively close the receiving opening which is extended perpendicularly to the sliding surface.

For the purposes of this disclosure, the indications of location and direction, such as "up", "down", "towards the front", "towards the rear", refer to the intended usage state of the dispenser on a horizontal placement surface.

As "cylindrical" housing part, a housing part is designated here which is configured at least in a longitudinal portion of the housing part in circumferential direction at least partially cylindrically, in order to enable the abutting of an advertising film over the full surface. In an embodiment, the cylindrical housing part is cut off in the lower region, therefore is only configured cylindrically in the upper region. Furthermore, the cylindrical housing part adjoining the cylindrical longitudinal portion can also comprise a non-cylindrical, for instance substantially conical longitudinal portion, in order to reproduce the shape of a bottle.

In a preferred embodiment, the dispenser comprises a fan which conveys the heated air from the chiller device to the ventilation opening in the clamping strip.

In order to enable a rapid and uncomplicated exchange of the advertising film, in a preferred embodiment the clamping device comprises two clamping strips on opposite long sides of the cylindrical housing part for clamping in place two opposite edge regions of the advertising film, wherein at the two clamping strips respectively at least one ventilation opening is formed. The heated air is thus blown off laterally from the chiller device at both opposite long sides of the housing.

In order to span the advertising film reliably and securely on the exterior of the cylindrical housing part, preferably a joint is provided for pivoting the clamping strip from a releasing position, releasing the edge region of the advertising film into a clamping position clamping the edge region of the advertising film in place. As the clamping strip is moved shortly before reaching the clamping position substantially tangentially to the exterior of the (partially) cylindrical housing part, the advertising film can be spanned securely up to the clamping position, whereby a favourable appearance is produced.

In order to as far as possible not disturb people in the environment of the dispenser by the exhaust air, the ventilation opening on the clamping strip is directed preferably obliquely upwards in the clamping position. Advantageously, therefore, the exhaust air is blown off at an angle of more than 0° and less than 90° to the horizontal.

In the clamping position, the clamping strip is preferably arranged at an angle of 45° to 65°, preferably of 50° to 60°, in particular substantially 55°, to the horizontal.

In order to keep the clamping strip reliably in the clamping position, preferably a detent device is provided for engaging the clamping strip in the clamping position. The detent device comprises interacting detent elements on the clamping strip and on the housing. For releasing the detent connection, depending on the embodiment, a button can be provided. In order to enable the opening of the clamping strip only for selected persons, the detent connection can alternatively only be released by a tool.

In order, on the one hand, to enable a secure clamping of the advertising film and, on the other hand, in order to improve the guiding of exhaust air, in a preferred embodiment the clamping strip extends substantially over the entire length of the cylindrical housing part.

In order to improve the clamping effect, in a further preferred embodiment, a rubber strip is provided on the inner side of the clamping strip, to secure the edge region of the advertising film. The rubber strip is made from a material with high friction, for example from TPE. Preferably, the rubber strip extends substantially over the entire length of the clamping strip.

The spanning of the advertising film in the clamping position of the clamping strip can be further increased when the rubber strip comprises individual rubber lips on the side facing the advertising film. Preferably, several rubber lips extend parallel to one another along the rubber strip. The rubber lips are spaced apart from one another by depressions.

With regard to the guiding of exhaust air, it is furthermore advantageous if the clamping strip comprises a number, in particular a plurality, of ventilation openings, in particular ventilation slits, which are preferably provided at regular intervals along the clamping strip.

For illumination of the advertising film from below, lighting elements, in particular LEDs, can be arranged beneath the clamping strip.

In order to be able to adjust the cooling capacity with regard to the desired drinking temperature, preferably at least one temperature sensor is provided for measuring the exterior temperature of a beverage container.

In a preferred embodiment, the temperature sensor for measuring the exterior temperature of the frontmost beverage container is arranged in the removal element. This embodiment is based on the knowledge that the chilling of the frontmost beverage container in the removal element is particularly difficult owing to the removal opening on the upper side. Therefore, preferably provision is made that the cooling capacity is adjusted depending on the exterior temperature of the frontmost beverage container.

According to a preferred embodiment, the chiller device comprises two lateral chilling surfaces substantially parallel to the lateral surfaces of the guide channel, and a curved chilling surface substantially parallel to a curved abutment region for the frontmost beverage container on an inner wall of the removal element.

In this embodiment, the frontmost beverage container is additionally chilled by the curved chilling surface on the removal element. In particular, it is advantageous that the frontmost beverage container in the removal element is pressed by the beverage container advancing behind against the curved abutment region of the inner wall of the removal element on which the correspondingly curved chilling surface of the chiller element is provided. Thereby, a contact over the entire surface between the covering surface of the frontmost beverage can and the chilled inner wall of the removal element is achieved, which substantially improves the chilling effect. In contrast thereto, a slight lateral play must be maintained along the guide channel between the beverage containers and the lateral surfaces of the guide channel, in order to enable the sliding along of the beverage containers. Owing to the chilling of the frontmost beverage container over the entire surface on the front side of the removal element, the desired drinking temperature can be achieved in an efficient manner.

According to a first preferred embodiment, the two lateral chilling surfaces of the chiller device extend along the lateral surfaces of the guide channel, and the curved chilling surface along the inner wall of the removal element. Therefore, the lateral chilling surfaces are part of the lateral surfaces of the guide channel, and the curved chilling surface is part of the inner wall of the removal element. This embodiment is suitable in particular in an embodiment of the chiller device with a Peltier element, which is connected with the chilling element in a heat-conducting manner.

According to a second preferred embodiment, the lateral chilling surfaces of the chiller device extend adjacent to the lateral surfaces of the guide channel, and the curved chilling surface extends adjacent to the inner wall of the removal element. In this embodiment, the lateral chilling surfaces are arranged at a distance from the lateral surfaces of the guide channel, and the curved chilling surface is arranged at a distance from the inner wall of the removal element. This embodiment is suitable in particular in an embodiment of the chiller device with a compressor chiller, wherein preferably an evaporator is provided, which surrounds the separate guide channel with the sliding surface and the inner wall of the removal element. Thereby, a freezing of the guide channel is prevented.

In order to configure the sliding surface with the required inclination, it is expedient if the housing is supported on a stand element for placing onto a flat placement surface, wherein the housing is arranged by means of the stand element at the angle of the sliding surface to the horizontal. The stand element can comprise, for example, a bracket which is able to be placed in a flat manner on the placement surface.

In order to bring the beverage containers individually into the removal position, it is expedient if the housing is connected with the removal element via a delivery opening which is extended substantially perpendicularly to the sliding surface, which removal element comprises a standing surface for a beverage container and a removal opening on the upper side. When a beverage container is removed from the removal element, the beverage container arranged therebehind slides into the removal element. The standing surface of the removal element preferably forms an extension of the sliding surface of the guide channel. In use, the beverage container preferably projects over an upper edge of the removal element, so that the beverage container can be removed in a barrier-free manner.

In a preferred embodiment, the advertising film is present and is held on the cylindrical housing part by means of the clamping device. The advertising film is preferably formed at least partially from a light guide film. Such light guide films (Lichtleiterfolien in German) are known in the prior art and can be formed in particular by a polyester film which according to the illumination layout is structured on the surface by a laser, printer or embossing tool.

The invention is explained further below by a preferred example embodiment, not limiting the invention.

DETAILED DESCRIPTION OF THE INVENTION

Figure 1:
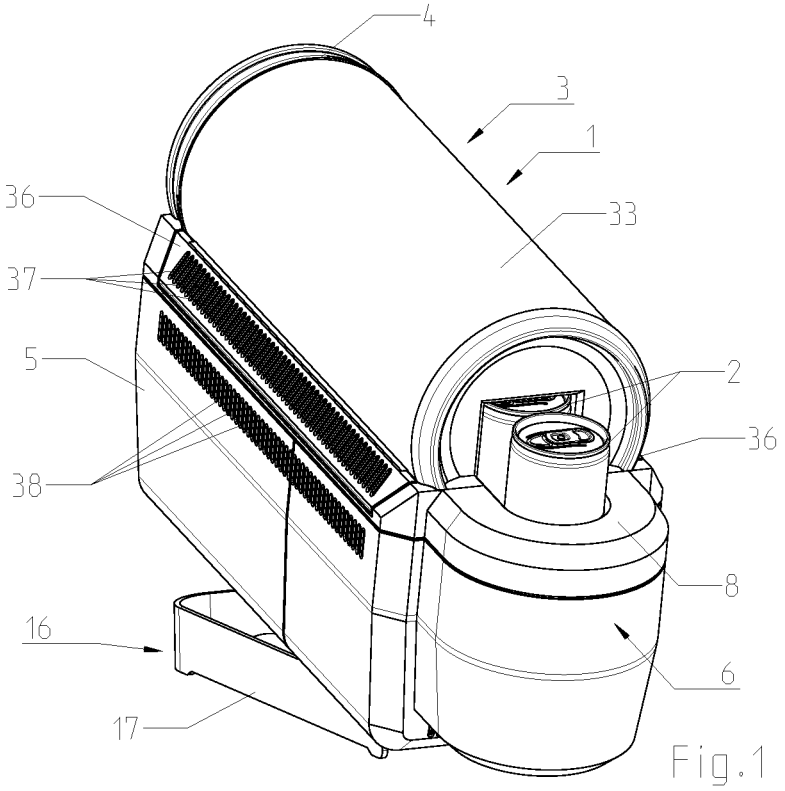
FIG. 1 shows a diagrammatic view of a can dispenser according to the invention.
Figure 2:
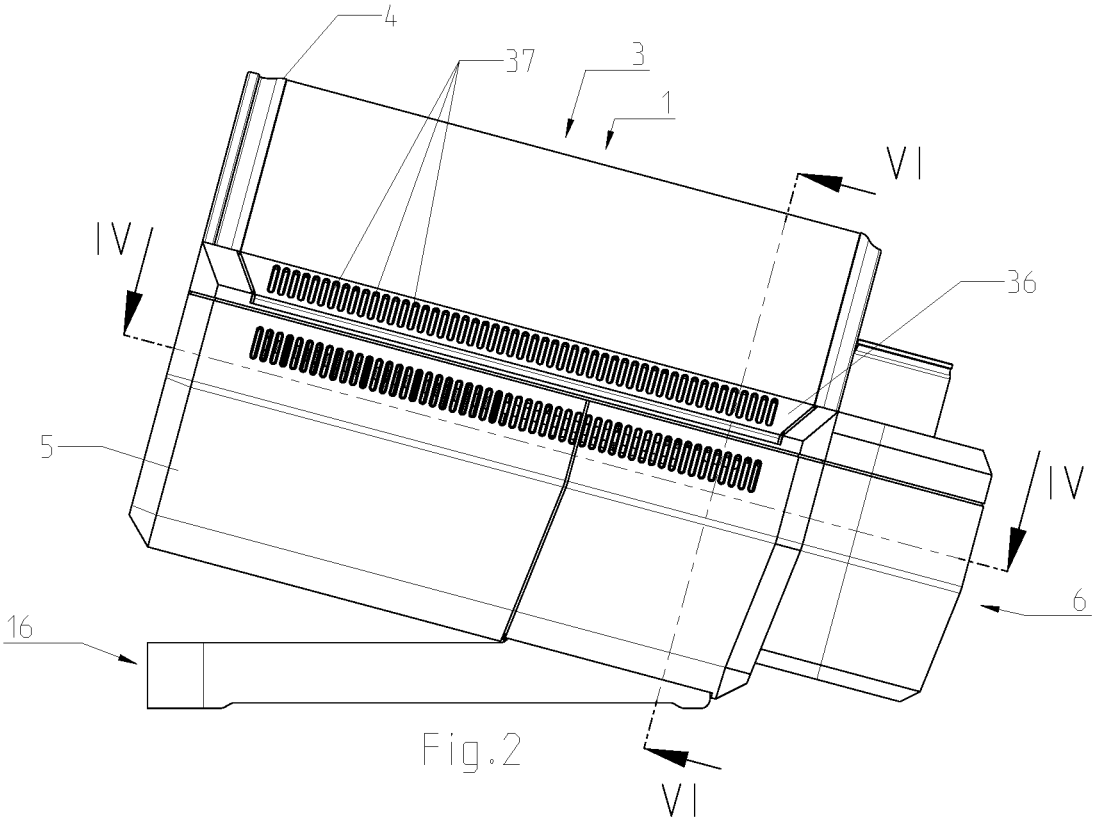
FIG. 2 shows a lateral view of the can dispenser according to FIG. 1.

The figures show a device, designated as dispenser 1, for dispensing elongate, at least partially substantially cylindrical beverage containers 2, which in the embodiment which is shown are formed by 250 ml beverage cans. The dispenser 1 has a housing 3 for receiving the beverage containers 2. The housing 3 has an upper, partially cylindrical housing part 4 and a lower, parallelepiped-shaped (or cuboid-shaped) housing part 5, which can be detachably connected with one another. On the front side, the device 1 has a removal element 6 in the form of a platform, at which a single beverage container 2 can be removed. For this purpose, the removal element 6 has a flat standing surface 14 (cf. FIG. 4), on which the beverage container 2 stands. The removal element 6 has on the upper side a removal opening 7, from which the beverage container 2 can be lifted out in a barrier-free manner, i.e. without removal of a cover or releasing of a closure device. The beverage container 2 projects upwards over a horizontal upper edge 8 of the removal element 6, in order to facilitate the removal of the beverage container 2. The dispenser 1 has, furthermore, a chiller device 9 (cf. FIG. 4), by which both the beverage containers 2 arranged within the housing 3 and also the beverage container 2 arranged within the removal element 6 can be chilled.

Figure 3:
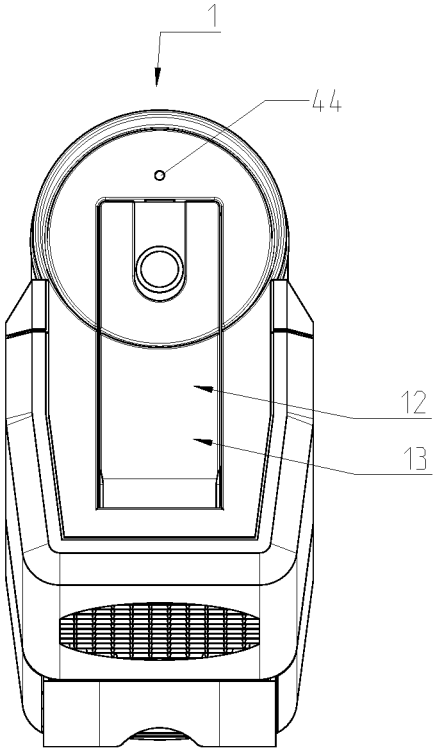
FIG. 3 shows a rear view of the can dispenser according to FIG. 1, 2.

As can be seen from FIG. 3, a display element 44, e.g. a light-emitting diode, is arranged on the rear side of the housing 3, which emits a signal, in particular a light signal, when no beverage container 2 is situated in the dispenser 1. The presence of the beverage containers 2 is monitored by presence sensors (not shown).

Figure 4:
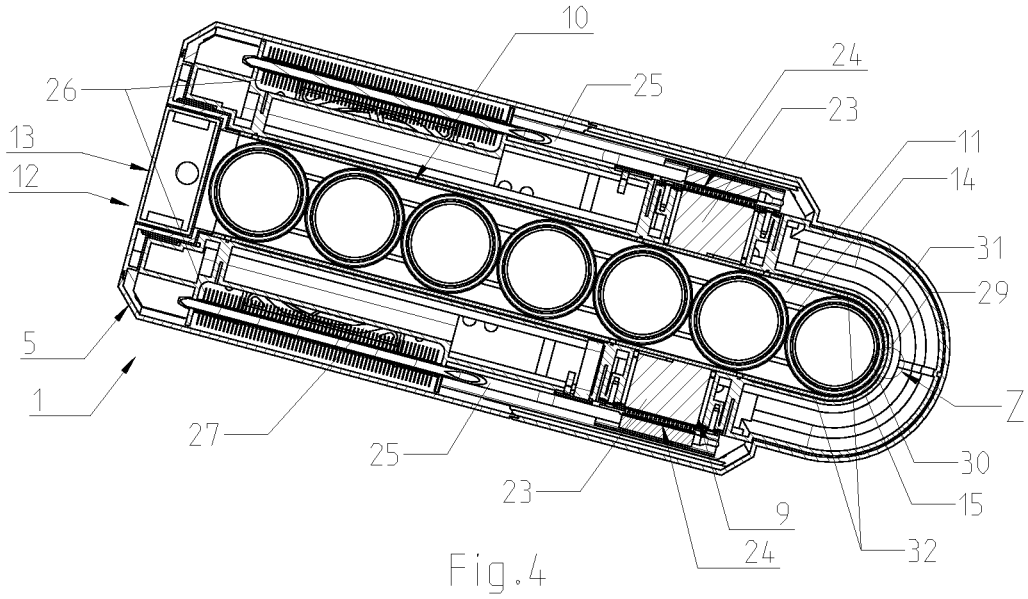
FIG. 4 shows a longitudinal section along the line IV-IV in FIG. 2.

As can be seen from FIG. 4, 6, the housing 3 has a conveying- and guide channel 10, extended in longitudinal direction of the housing 3, within the housing 3, with a sliding surface 11, inclined forward to the horizontal, in the direction of the removal element 6, on the underside. The width of the guide channel 10, i.e. its shorter extent in cross-section perpendicularly to the conveying direction, is less than the height of the guide channel 10, i.e. its extent perpendicularly to the sliding surface 11. Thereby, the beverage containers 2 can slide in upright or respectively vertical state along the sliding surface 11 of the guide channel 10, in contrast to a rolling bearing as in many known can dispensers. Accordingly, a beverage container 2, in (still) unfilled state of the device 1, can slip into the removal element 6 under the influence of gravity. In so doing, the base surface of the beverage container 2, facing away from the drinking opening, slides on the sliding surface 11 of the guide channel 10. As soon as the beverage container 2 is removed, the beverage container 2 arranged therebehind slips along from the guide channel 10 into the removal element 6. For this purpose, the housing 3 has at the side of the removal element 6 a delivery opening, extended substantially perpendicularly to the sliding surface 11, which delivery opening is shaped substantially in accordance with the beverage container 2. The lateral faces 20, 21 of the guide channel 10 extend partially in the lower housing part 5 and partially in the upper housing part 4.

As can be seen from FIG. 3, the housing 3 has on the side facing away from the removal element 6 a receiving opening 12, extended substantially perpendicularly to the sliding surface, for the inserting of beverage containers 2 into the guide channel 10. For closing the receiving opening 12, a closure element 13 is provided, which in the embodiment which is shown is configured as a flap which is pivotable between a position of use, closing the receiving opening 12 (cf. FIG. 3), and a loading position (not shown), freeing the receiving opening 12.

In the embodiment which is shown, the housing 3 is connected with a stand element 16, which is placed on a flat placement surface, wherein the housing 3 is arranged with the sliding surface 11 at an angle to the horizontal, which enables an automatic sliding of the beverage containers 2 over the sliding surface 11. In the embodiment which is shown, the stand element 16 has a bracket 17 resting in a flat manner on the placement surface. Thereby, a free space is created between the upper side of the bracket 17 and the underside of the lower housing part 5.

Figure 6:
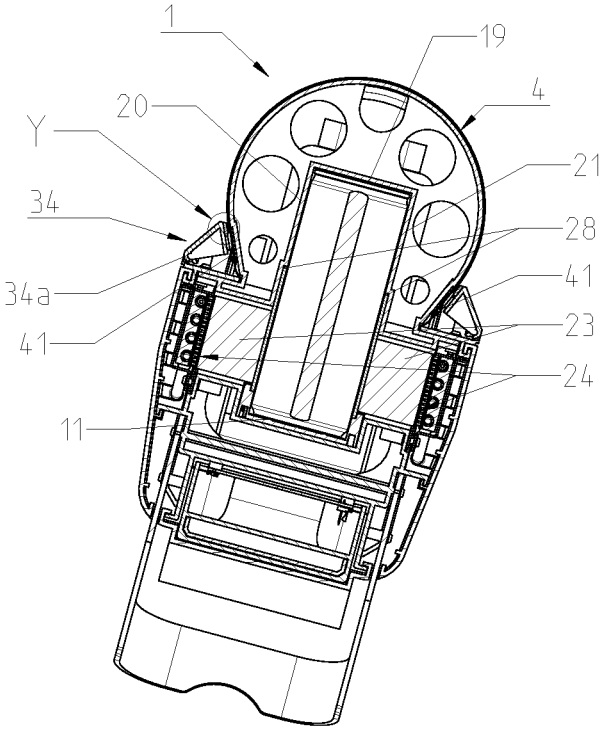
FIG. 6 shows a cross-section along the line VI-VI in FIG. 2.

As can be seen from FIG. 6, the guide channel 10 has on the upper side, i.e. opposite the sliding surface 11, a flat retaining surface 19, extended parallel to the sliding surface 11, to secure the beverage containers 2 in the guide channel 10 against tipping over. Furthermore, the guide channel 10 has in each case a first lateral surface 20 and a second lateral surface 21, which are extended substantially perpendicularly to the sliding surface 11. The height of the guide channel 10, i.e. the extent between the sliding surface 10 and the retaining surface 19 is 1.0055 times greater in the embodiment which is shown, than the height of the beverage container 2 arranged therein. In the case of the 250 ml beverage can, the height of the guide channel 10 amounts to substantially 135.75 mm, and the height of the beverage container 2 arranged therein amounts to substantially 135 mm. The width of the guide channel 10 between the first lateral surface 20 and second lateral surface 21 amounts to substantially 54.5 mm.

As can be seen from FIG. 4 and FIG. 6, the chiller device 9 in the embodiment which is shown has a chiller element 22, which is connected with two Peltier elements 24 via two cold transmission elements 23 in the form of metal blocks. The Peltier elements 24 are connected with cooling fins 26 via heat conductors 25. In the lower region of the housing 3, a fan 27 is arranged, in order to transport the heated air out from the housing 3.

Figure 5:
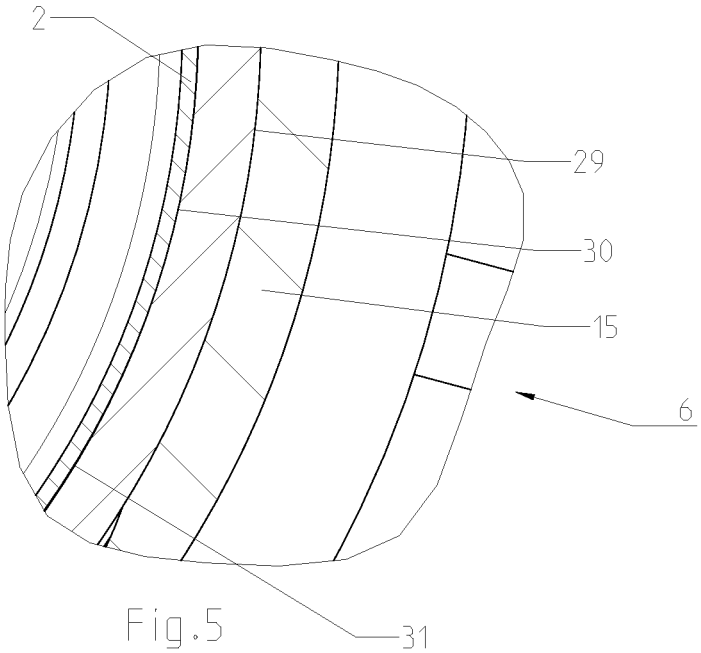
FIG. 5 shows the detail Z of FIG. 4.

As can be seen from FIG. 4 and FIG. 6, the chiller element 22 has two lateral chilling surfaces 28, along the lateral surfaces 20, 21 of the guide channel 10. The lateral chilling surfaces 28 preferably extent over at least half the height of the guide channel 10. In addition, the chiller element 22 has a curved chilling surface 29 (cf. in detail FIG. 5) in the removal element 6, which in the embodiment which is shown has the same height as the lateral chilling surfaces 28. The curved chilling surface 29 extends along a curved abutment region 30 on an inner wall 31 of the removal element 6, which stands up from the standing surface 14 of the removal element 6. In the embodiment which is shown, the curved chilling surface 29, viewed in longitudinal section through the dispenser 1 (parallel to the sliding surface 11) is configured in a substantially semi-circular manner. The curved chilling surface 29 at the abutment region 30 of the removal element 6 is connected with the lateral chilling surfaces 28 at the lateral surfaces 20, 21 of the guide channel 10 via flat connecting chilling surfaces 32. For the formation of the chiller element 22, a plate part made of a material having good heat-conducting properties, here metal, for example aluminium, is provided, on which the lateral chilling surfaces 20, 21 along the guide channel 10, and the front chilling surfaces 29, 32 along the inner wall 31 of the removal element 6, are formed in one piece. In the embodiment which is shown, the removal element 6 has an insulation 15. Furthermore, at least one temperature sensor (not shown) can be provided for measuring the exterior temperature of a beverage container 2. To measure the exterior temperature of the frontmost beverage container 2 at least one temperature sensor is arranged in the removal element 6.

Figure 7:
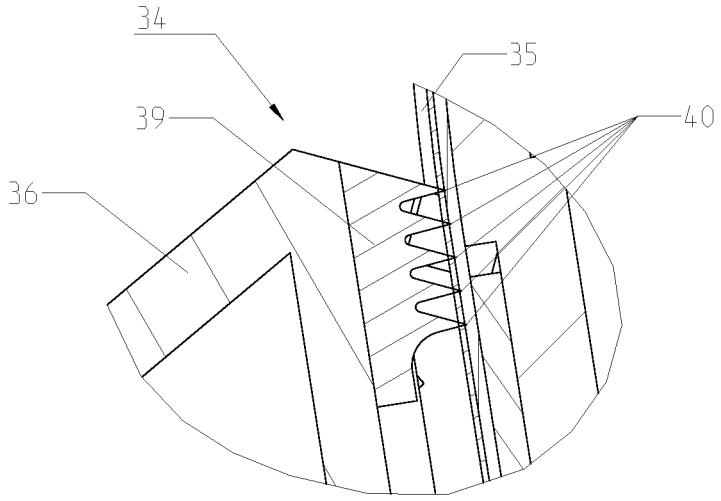
FIG. 7 shows the detail Y of FIG. 6.

As can be seen from FIG. 1 (cf. also FIG. 10), an advertising film 33 is arranged on the exterior of the cylindrical housing part 4. In order to enable a changing of the advertising film 33, a clamping device 34 (cf. in detail FIG. 6 and FIG. 7) is provided for the clamping of opposite edge regions 35 of the advertising film 33 against the exterior of the cylindrical housing part 4. The clamping device 34 has on each long side, therefore on the sides extended in longitudinal direction of the guide channel 10, of the cylindrical housing part 4, a clamping strip 36 which extends respectively substantially over the entire length (i.e. extent in longitudinal direction of the guide channel 10) of the cylindrical housing part 4. The clamping strips 36 are arranged pivotably on the housing 3 via joints 34*a* (cf. FIG. 6). For changing the advertising film 33, the clamping strips 36 can be pivoted from a clamping position clamping the opposite edge regions 35 of the advertising film 33 (cf. FIG. 1) into a releasing position releasing the edge regions 35 of the advertising film 33 (cf. FIG. 9). In the position of use of the dispenser 1, the clamping strips 36 are fixed in the clamping position via in each case a detent device (not shown).

As can be seen furthermore from FIG. 1, the clamping strips 36 have respectively a plurality of ventilation openings 37 in the form of ventilation slits, which are arranged at regular intervals along the clamping strips 36. Via the ventilation openings 37 the heated air from the operation of the chiller device 9 can be dissipated substantially better to the surroundings than would be possible only with conventional ventilation openings 38 at the lower housing part 5. The ventilation openings 37 at the clamping strips 36 are directed obliquely upwards in the clamping position. The angle of the clamping strips 36 (and hence of the ventilation openings 37) is arranged in the clamping position at an angle of 45° to 65°, preferably of 50° to 60°, in particular substantially 55°, to the horizontal.

As can be seen from FIG. 6 (and in the detail from FIG. 7), on the inner side of the clamping strip 36 a rubber strip 39 is fastened for securing the edge region 35 of the advertising film 33. The rubber strip 39 has at the side of the advertising film 33 individual rubber lips 40 which improve the hold on the advertising film 33.

As can be seen from FIG. 6, lighting elements 41, here LEDs, are arranged beneath the clamping strip 36. The advertising film 33 is illuminated by the lighting elements 41, said advertising film being preferably configured here as a light guide film for this purpose.

Figure 8:
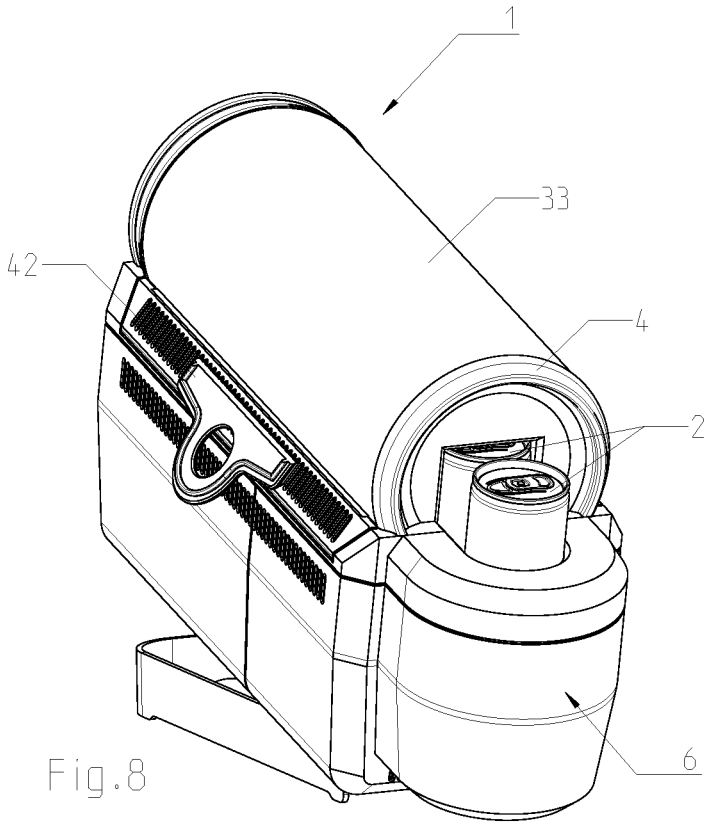
FIGS. 8 to 12 show successive steps on changing an advertising film of the can dispenser according to the invention.
Figure 9:
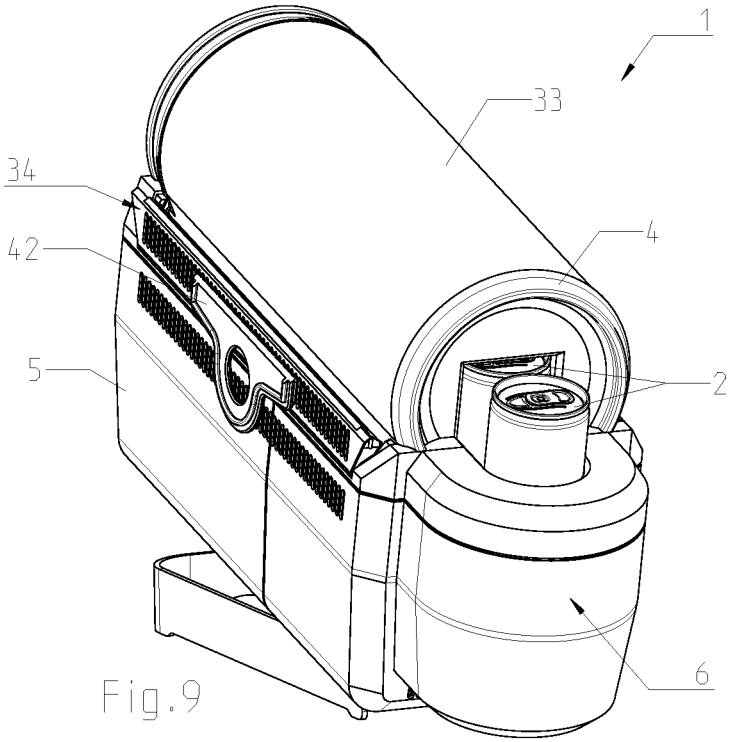
Figure 10:
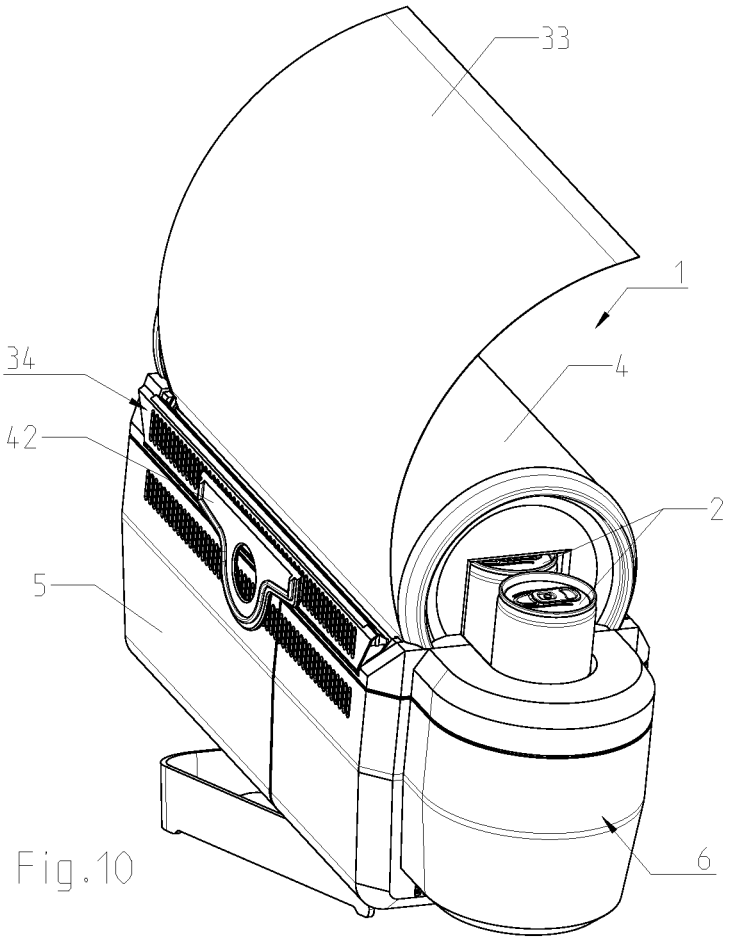
Figure 11:
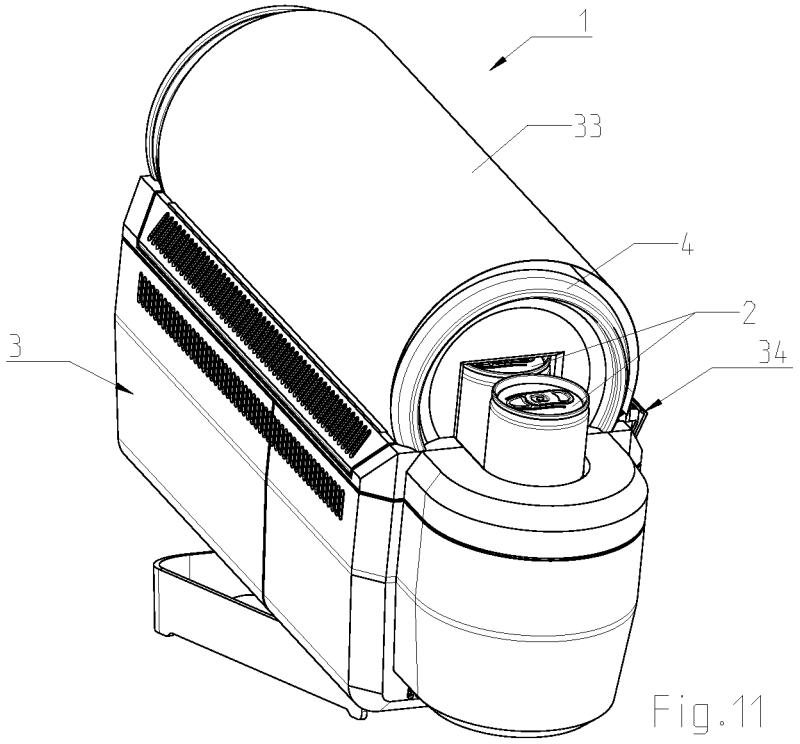
Figure 12:
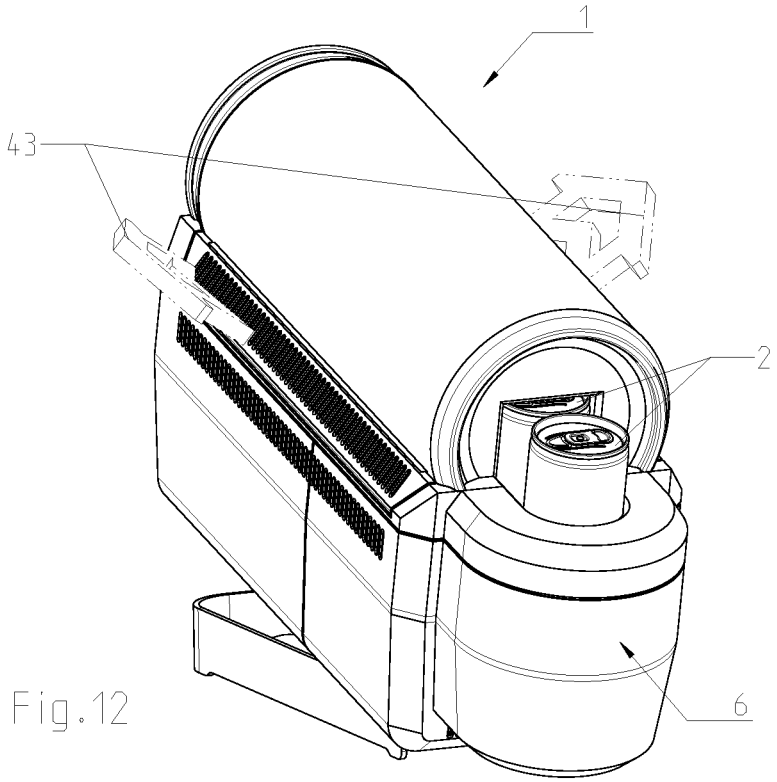

The sequence during changing of the advertising film 33 can be seen from FIGS. 8 to 12. Firstly, a tool 42 is brought into engagement with the ventilation openings 37 on the clamping strip 36 (FIG. 8). Subsequently, the clamping strip 36 can be pivoted outwards into the releasing position by means of the tool 42 (FIG. 9). Also on the opposite long side, the clamping strip 36 is released. Thereafter, the advertising film 33 can be removed and replaced by another advertising film. The new advertising film is fixed by the clamping strips 36 again (FIG. 11). In use of the dispenser 1, the exhaust air of the chiller device 9 flows obliquely upwards out of the ventilation slits of the clamping strips 36 (cf. arrow 43 in FIG. 12).

The invention claimed is:

1. A dispenser (1) for dispensing elongate beverage containers (2), comprising:

a housing (3) with a cylindrical housing part (4), a rear-side insertion opening (12) for inserting beverage containers (2) and a front-side removal element (6) open at the top, for removing the frontmost beverage container (2);

a guide channel (10) with a sliding surface (11) sloping downwards towards the front for conveying the beverage containers (2) in an upright state from the rear-side receiving opening (12) into the front-side removal element (6);

a chiller device (9) for chilling the beverage containers (2); and a clamping device (34) for clamping in place an edge region (35) of an advertising film (33) on the exterior of the cylindrical housing part (4), the clamping device (34) comprising on a long side of the cylindrical housing part (4) a clamping strip (36) comprising at least one ventilation opening (37) for dissipating heated air from the chiller device (9) to the surroundings.

2. The dispenser (1) according to claim 1, wherein an elongate beverage container (2) is present, which is arranged in the removal element (6).

3. The dispenser (1) according to claim 1, further comprising an advertising film, which is held on the cylindrical housing part (4) by means of the clamping device (34).

4. The dispenser (1) according to claim 1, wherein lighting elements (41) are arranged beneath the clamping strip (36).

5. The dispenser (1) according to claim 1, wherein the clamping strip (36) comprises a number of ventilation openings (37).

6. The dispenser (1) according to claim 1, wherein the clamping strip (36) extends substantially over the entire length of the cylindrical housing part (4).

7. The dispenser (1) according to claim 1, wherein the clamping device (34) comprises two clamping strips (36) on opposite long sides of the cylindrical housing part (4) for clamping in place two opposite edge regions (35) of the advertising film (33), wherein respectively at least one ventilation opening (37) is formed at the two clamping strips (36).

8. The dispenser (1) according to claim 1, wherein a joint (34*a*) is provided for pivoting the clamping strip (36) from a releasing position releasing the edge region (35) of the advertising film (33) into a clamping position clamping in place the edge region (35) of the advertising film (33).

9. The dispenser (1) according to claim 1, wherein the ventilation opening (37) on the clamping strip (36) is directed obliquely upwards in the clamping position.

10. The dispenser (1) according to claim 9, wherein the clamping strip (36) in the clamping position is arranged at an angle of 45° to 65°, or 50° to 60°, or substantially 55°, to the horizontal.

11. The dispenser (1) according to claim 8, wherein a detent device is provided for engaging the clamping strip (36) in the clamping position.

12. The dispenser (1) according to claim 1, wherein on the inner side of the clamping strip (36) a rubber strip (39) is provided for securing the edge region (35) of the advertising film (33).

13. The dispenser (1) according to claim 12, wherein the rubber strip (39) comprises individual rubber lips (40) on the side facing the advertising film (33).

14. The dispenser (1) according to claim 1, wherein at least one temperature sensor is provided for measuring the exterior temperature of a beverage container.

15. The dispenser (1) according to claim 14, wherein the temperature sensor for measuring the exterior temperature of the frontmost beverage container (2) is arranged in the removal element (6).

16. The dispenser (1) according to claim 1, wherein the chiller device (9) comprises two lateral chilling surfaces (28) substantially parallel to the lateral surfaces (20, 21) of the guide channel (10), and a curved chilling surface (29) substantially parallel to a curved abutment region (30) for the frontmost beverage container (2) on an inner wall (31) of the removal element (6).

17. The dispenser (1) according to claim 16, wherein the advertising film (33) is formed at least partially from a light guide film.

18. The dispenser (1) according to claim 5, wherein the ventilation openings (37) comprise ventilation slits provided at regular intervals along the clamping strip (36).

19. The dispenser (1) according to claim 4, wherein the lighting elements (41) comprise LEDs.

* * * * *